US005220119A

United States Patent [19]

Shimada

[11] Patent Number: 5,220,119

[45] Date of Patent: Jun. 15, 1993

[54] ELECTRONIC MUSICAL INSTRUMENT WITH PLAYBACK AND EDIT FUNCTIONS OF PERFORMANCE DATA

[75] Inventor: Yoshihisa Shimada, Hamamatsu, Japan

[73] Assignee: Kabushiki Kaisha Kawai Gakki Seisakusho, Shizuoka, Japan

[21] Appl. No.: 780,290

[22] Filed: Oct. 22, 1991

[30] Foreign Application Priority Data

Oct. 23, 1990 [JP] Japan ..... 2-285662

[51] Int. Cl.[5] ..... G10H 7/00; G04B 13/00; A63H 5/00

[52] U.S. Cl. ..... 84/609; 84/649

[58] Field of Search ..... 84/609-614, 84/649-652

[56] References Cited

U.S. PATENT DOCUMENTS

| | | | |
|---|---|---|---|
| 3,781,452 | 12/1973 | Vanclain | 84/DIG. 29 X |
| 3,955,466 | 5/1976 | Goldmark | 84/470 |
| 4,876,938 | 10/1989 | Shinohara | 84/611 |
| 4,899,632 | 2/1990 | Okamura | 84/601 |
| 4,924,745 | 5/1990 | Kimpara et al. | 84/609 |
| 4,953,438 | 9/1990 | Shibukawa | 84/609 |
| 4,960,030 | 10/1990 | Fujimori | 84/609 |
| 5,085,116 | 2/1992 | Nakata et al. | 84/609 |
| 5,092,216 | 3/1992 | Wadhams | 84/602 |
| 5,131,309 | 7/1992 | Nishikawa et al. | 84/601 |

FOREIGN PATENT DOCUMENTS

| | | | |
|---|---|---|---|
| 1-227195 | 9/1989 | Japan | 84/609 |

*Primary Examiner*—Stanley J. Witkowski
*Assistant Examiner*—Jeffrey W. Donels

[57] ABSTRACT

In an electronic musical instrument, first performance data stored in a memory, including a note data string, are read, and are supplied to a tone generator to obtain tone signals. The first performance data are transferred to an edit area in a RAM. A user performs a keyboard operation at a desired timing while listening to playback tones based on the output from the tone generator, thereby additionally writing corresponding second performance data for one tone in the edit area using time base data common to the first performance data. Non-edited note data and additionally written note data are distinguished from each other on the basis of tag data, and one of these two data is erased to continue an edit operation.

10 Claims, 9 Drawing Sheets

ELECTRONIC MUSICAL INSTRUMENT WITH PLAYBACK AND EDIT FUNCTIONS OF PERFORMANCE DATA

BACKGROUND OF THE INVENTION

1. Field of the Invention

The present invention relates to a performance data recording apparatus and, more particularly, to a recording apparatus for use in an electronic musical instrument which records performance data on a storage medium, and performs an automatic performance by playing back recorded data.

2. Description of the Prior Art

In some electronic musical instruments, operation states (numbers of operated keys and switches, key ON or OFF timings, key ON speeds, and the like) of a keyboard (keys), panel switches, and the like are stored, and in a playback mode, the operations of the keyboard and the panel switches are electrically reproduced on the basis of playback data, thereby performing an automatic performance of a music piece. Such an electronic musical instrument is also called an automatic performance apparatus. With this apparatus, a user may purchase a storage medium (floppy disk or ROM) which has contains previously recorded performance data, and may play back the performance data in addition to a recording/playback operation of his or her own performance.

An automatic performance apparatus of this type has a correction (edit) function. For example, a read switch is arranged, so that stored performance data is read out note by note, and is rewritten with another note. Also, a storage address return switch is arranged, so that a rewrite operation can be readily performed in units of bars (measures) (e.g., Japanese Patent Laid-Open No. 63-193195).

The performance data correction or edit function of the above-mentioned automatic performance apparatus can locally correct or insert recorded performance data, but cannot correct or insert data in relation to the flow of the overall music piece. In other words, since local correction or insertion of data cannot satisfactorily correct the overall music piece, an edit operation must be repeated.

SUMMARY OF THE INVENTION

It is an object of the present invention to provide a recording apparatus which allows an edit operation in relation to the overall flow of a music piece.

It is another object of the present invention to provide a recording apparatus which can readily and quickly perform an edit operation, e.g., a change or restoration of note data by erasing one of edited or non-edited note data corresponding to a designated bar and beat from edited data which include both non-edited and edited note data.

A performance data recording apparatus of the present invention comprises read means 30 for reading out performance data A recorded in correspondence with operations of a keyboard from storage means b, and supplying performance data A to tone generation means 17 in accordance with data added to the performance data A, and indicating a performance time, first write means 31 for rewriting the performance data A produced by the tone generation means 17 in storage means, and a second write means 33, operated in parallel with the read means 30 and the write means 31, for writing performance data B generated in correspondence with operations of the keyboard in the storage means a together with the data indicating the performance time along a time base common to the performance data A.

With the above arrangement, a user can additionally record (overwrite) necessary performance data B in a necessary portion while listening to playback tones of recorded performance data A. Therefore, in an edit mode, the user can insert or correct proper tones and confirm the overall flow of the recorded performance, thus facilitating composition.

DETAILED DESCRIPTION OF THE PREFERRED EMBODIMENT

Figure 1:
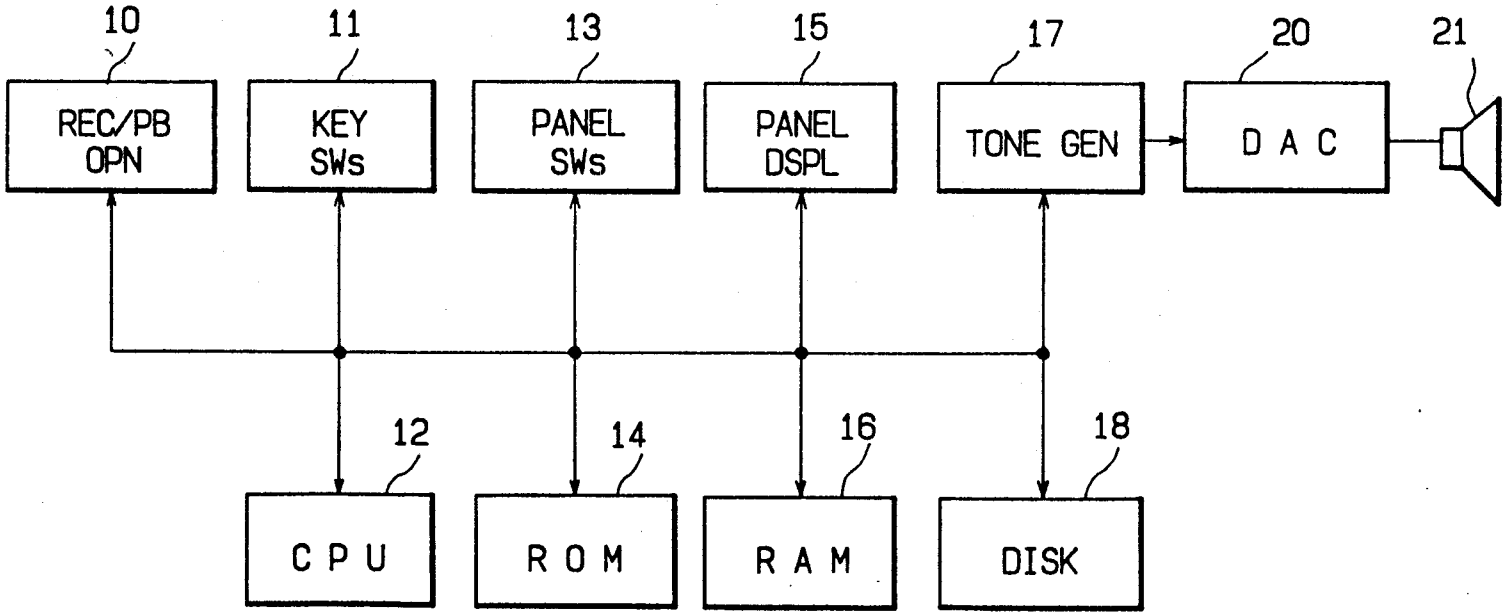
FIG. 1 is a block diagram of an electronic musical instrument comprising an automatic performance apparatus according to an embodiment of the present invention.

FIG. 1 is a block diagram of an electronic musical instrument comprising an automatic performance apparatus according to an embodiment of the present invention.

This electronic musical instrument comprises, as operation means, key switches 11 corresponding to a keyboard, and panel switches 13 for setting performance parameters such as a tempo, and the like. Operations of these key switches 11 and the panel switches 13 are detected in a key scan routine executed by a CPU 12, and switch operation data including numbers of the operated keys and panel switches, key ON and OFF timings, key depression strengths, and the like are stored in a register in the CPU, and a RAM 16.

The CPU 12 sends tone control signals corresponding to the above-mentioned switch operation data to a tone generator 17 in an output routine. The tone generator 17 comprises a plurality of tone generation channels for generating PCM tone signals corresponding to piano tones, violin tones, and the like, and forms tone signals having predetermined frequencies, waveforms, amplitudes, sustain times, and the like on the basis of the tone control signals from the CPU 12. The tone signals are converted into analog audio signals by a D/A converter (DAC) 20, and are played back by a loudspeaker 21.

The key scan routine and the output routine are executed in accordance with a main processing program written in a ROM 14. The CPU 12 controls the ON/-OFF state of a panel display unit 15 in correspondence with operations of the panel switches 13 or values in the internal register. The CPU 12 transfers performance data stored in the RAM 16 to a disk device 18, thereby recording performance data on, e.g., a floppy disk.

In a playback performance mode, performance data played back from the disk device 18 are transferred to the RAM 16, and tone control signals for an automatic performance are sent to the tone generator 17 in the above-mentioned output routine. In this manner, an automatic performance of playback tones can be performed via the tone generator 17, the D/A converter 20, and the loudspeaker 21 in the same manner as in a real-time performance mode.

A recording/playback operation unit 10 includes switches and an indicator used when chord data is recorded/played back.

Figure 2:
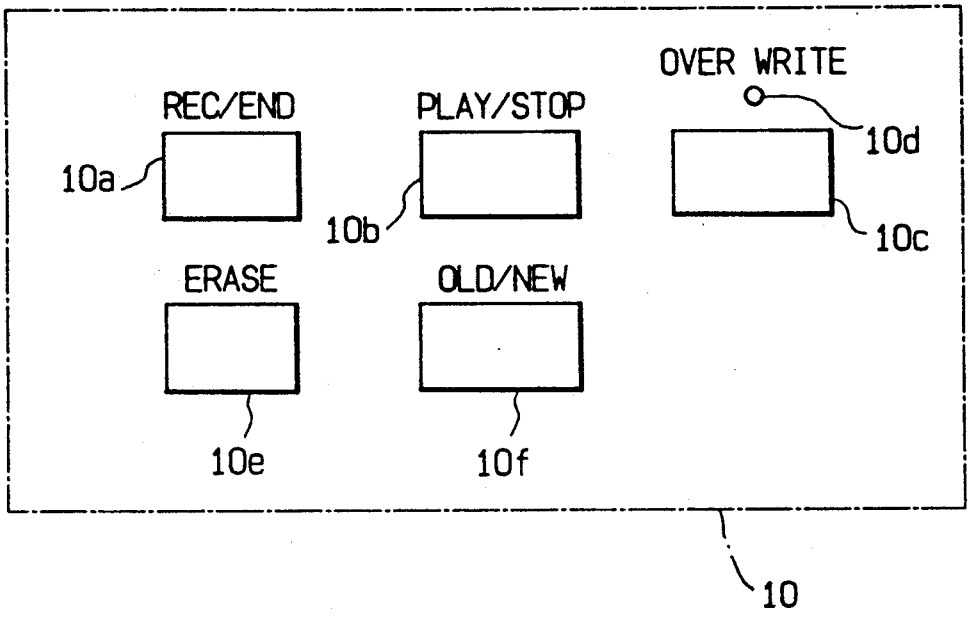
FIG. 2 is a partial front view of a recording/playback operation unit shown in FIG. 1.

As shown in FIG. 2, the recording/playback operation unit 10 comprises a recording/end button 10*a* for a recording mode, a playback/stop button 10*b* for a playback mode, an overwrite button 10*c* used for overwriting new data on recorded data, an erase button 10*e*, and a data designation button 10*f* for designating data to be erased, i.e., old data or overwritten new data An LED 10*d* for indicating an overwrite mode is arranged above the overwrite button 10*c*. Note that the recording/playback operation unit 10 includes note designation switches for designating a whole note, a quarter note, and the like in addition to the above-mentioned buttons.

Figure 3:
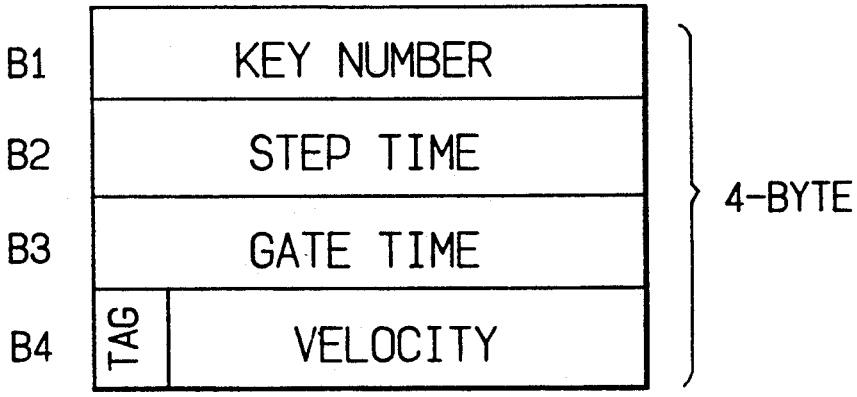
FIG. 3 shows a format of recorded key data.

FIG. 3 shows key data recorded in the RAM 16 or the disk device 18 shown in FIG. 1. The key data consists of four bytes B1 to B4. The first byte B1 stores a key number, i.e., a number of an operated key. The second byte B2 stores a step time, i.e., a time from the beginning of each beat in a bar until the corresponding key is depressed as the number of clocks. The clocks are generated at a speed 96 times that of, e.g., quarter notes, and this speed is varied in proportion to a tempo speed set by the corresponding panel switch 13. The third byte B3 stores a gate time, i.e., a time between key ON and OFF events as the number of clocks. The fourth byte B4 stores a velocity, i.e., a key depression speed corresponding to a key depression pressure. Note that the most significant bit (MSB) of the fourth byte B4 corresponds to tag data (to be described later), and is set to be "1" in the overwrite mode.

Figure 4:
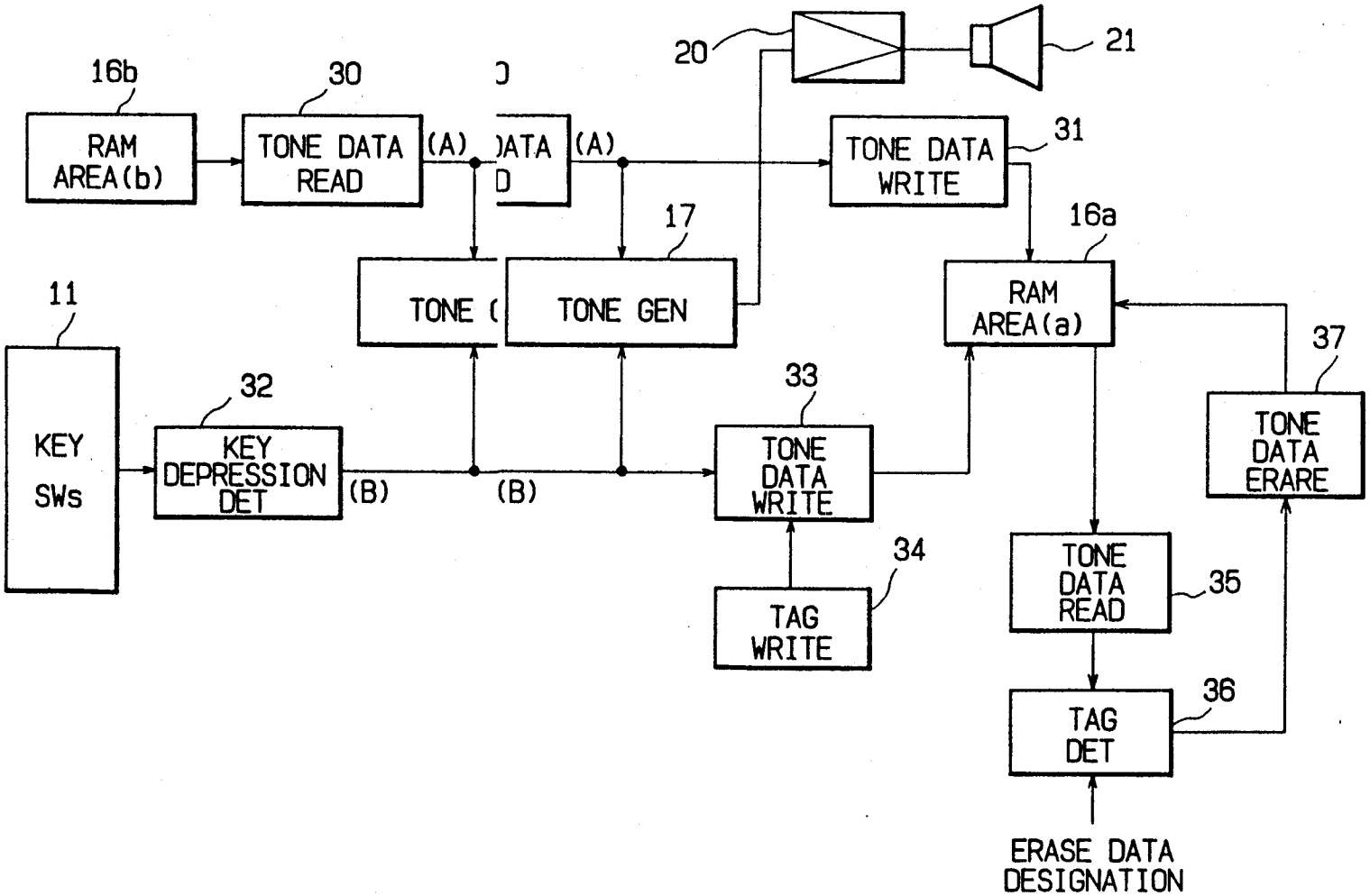
FIG. 4 is a functional block diagram corresponding to an overwrite-recording mode of the automatic performance apparatus of the embodiment shown in FIG. 1.
Figure 5:
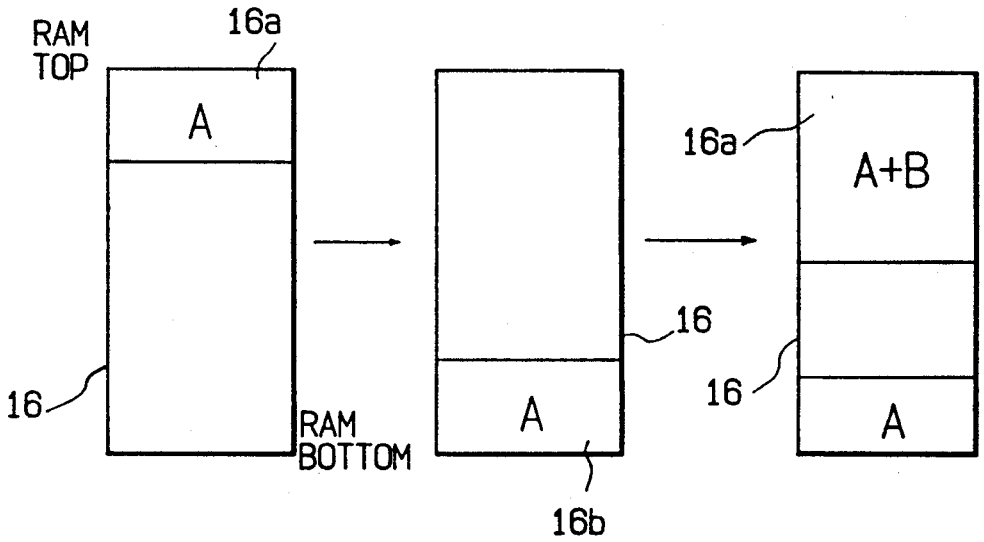
FIG. 5 is a view showing a transfer function of a RAM 16 in an overwrite mode.

FIG. 4 is a functional block diagram corresponding to the overwrite mode of the automatic performance apparatus of this embodiment. A series of 4-byte key data are written in the RAM 16 shown in FIG. 1. When the overwrite button 10*c* (FIG. 2) is depressed, the LED 10*d* is turned on, and the overwrite mode is set. In this case, the already recorded performance data A are transferred from an area 16*a* to an area 16*b* of the RAM 16, as shown in FIG. 5. When the recording button 10*a* (FIG. 2) is depressed in this state, the performance data A in the RAM area 16*b* are read out at a predetermined tempo speed under the control of a read means 30, and the readout data are supplied to the tone generator 17. Thus, a tone playback operation corresponding to the performance data A is performed through an amplifier 20 and the loudspeaker 21, which are connected to the output of the tone generator 17. At the same time, the performance data A read out from the RAM area 16*b* are written again in the original RAM area 16*a* via a write means 31.

Meanwhile, the operations of the key switches 11 corresponding to keyboard operations are detected by a key depression detector 32, and detected performance data B are supplied to the tone generator 17, thus producing tones corresponding to the keyboard operations. The performance data B output from the key depression detector 32 are written in the RAM area 16*a* via a write means 33. Therefore, as shown in FIG. 5, the playback performance data A and additionally played performance data B during the playback operation are mixed and recorded in the RAM area 16*a*. Note that the write means 31 and 33 increment addresses, so that the playback performance data A and additional performance data B are serially written in the RAM area 16*a* in the order of their generation times.

Therefore, a player can operate the keyboard at a necessary portion while listening to playback tones of the already recorded performance data A, thereby additionally writing (overwriting) the performance data B. The performance data B may be an accompaniment, or may be a correction performance for partially correcting the performance data A.

When the performance data B are additionally written, a tag write means 34 is operated, and tag data "1" is recorded in the MSB of the fourth byte B4 of the key data, as shown in FIG. 3. On the other hand, tag data of the already recorded performance data A is "0". Therefore, whether data is already recorded data or additionally recorded data can be discriminated by checking the tag data. In the erase mode, one of the already recorded data A and the additionally recorded data B can be selected and erased, and the other data can be left.

The erase mode is started when the erase button 10*e* of the recording/playback operation unit 10 shown in FIG. 2 is depressed. The data designation button 10*f* is then depressed to designate whether key data to be erased is old data or new data (overwritten data). The panel switches 13 are then operated while observing the bar numbers and the beat numbers displayed on the panel display unit 15 shown in FIG. 1, thereby designating the numbers of the bar and beat to be erased. Upon completion of this designation, a read means 35 (FIG. 4) reads out key data to be erased from the addresses of the corresponding bar and beat numbers in the RAM area 16*a*. The readout key data is supplied to a tag detection means 36, and the tag data is extracted from the fourth byte of the key data. The tag detection means 36 compares new data/old data ("1"/"0") designated by the data designation button 10*f* with the read tag data "1"/"0", and if a coincidence between the two data is found, the means 36 outputs an erase enable signal to a data erase means 37. Upon reception of the erase enable signal, the data erase means 37 writes, e.g., all-"0" data at the corresponding addresses of the RAM area 16*a*. As a result, the designated key data is erased.

Figure 6:
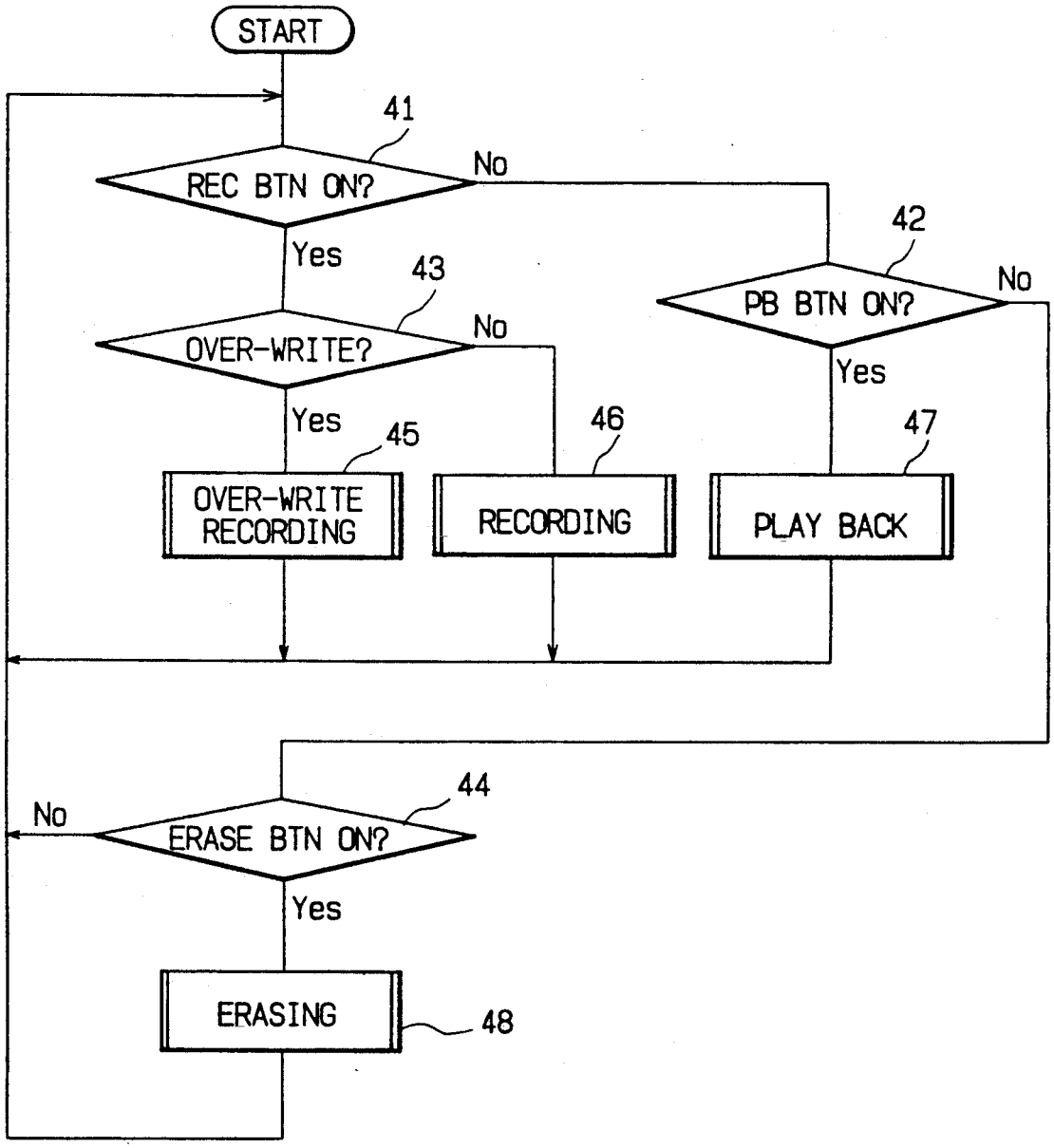
FIG. 6 is a flow chart showing recording;playback/-erasing processing in a main routine.

The functional blocks shown in FIG. 4 are realized by the CPU 12 (FIG. 1) and the processing program written in the ROM 14. FIG. 6 shows a main routine of recording/playback processing. In steps 41, 42, and 44, the operations of the recording button 10*a*, the playback button 10*b*, and the erase button 10*e* of the recording/playback operation unit 10 are detected, and corresponding recording processing (step 46), playback processing (step 47), and erase processing (step 48) are executed. When the overwrite button 10*c* is depressed after the recording button 10*a* is depressed, overwrite-recording processing is executed.

Figure 7:
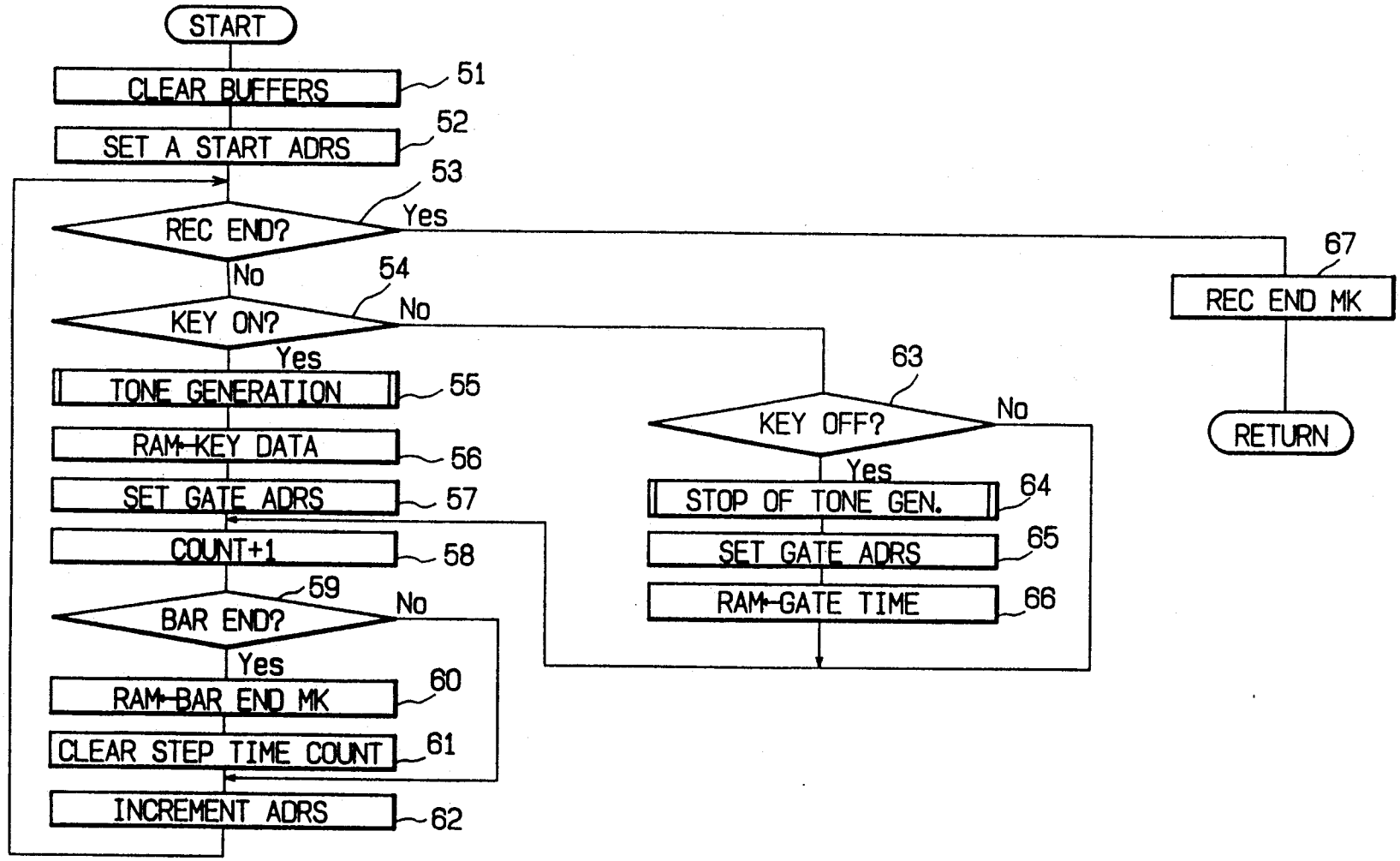
FIG. 7 is a flow chart showing recording processing shown in FIG. 6.

FIG. 7 shows the flow of the recording processing routine. In step 51, buffers such as registers, flags, and the like set in the working area in the RAM 16 are cleared, and in step 52, the start address of the RAM area 16*a* as a recording area is set. In step 53, it is checked if the recording end button 10*a* (common to the recording button) is depressed. If NO in step 53, it is checked in step 54 if a key ON event of a keyboard is detected. If YES in step 53, tone generation processing is executed in step 55. In step 56, key data (key number, step time, and velocity data shown in FIG. 3) is written at the current address of the RAM 6. Furthermore, in step 57, a RAM address for storing a gate time between key ON and OFF events is set, and the RAM content at the corresponding address is cleared.

In step 58, a step time counter is incremented by one in synchronism with tempo clocks, and it is then checked in step 59 if the count value has reached a bar end. If NO in step 59, the address of the recording area of the RAM 16 is incremented by four bytes in step 62. The flow then returns to step 53 to repeat the above-mentioned processing. If the bar end is detected in step 59, a bar end mark is written in the RAM in step 60, and the step time count value is cleared in step 61.

If no key ON event is detected in step 54, it is checked in step 63 if a key OFF event is detected. If YES in step 63, tone generation stop processing is executed in step 64. In step 65, an address for storing a gate time is set, and in step 66, the gate time is written at the corresponding address of the RAM 16.

If the operation of the recording end button 10*a* is detected in step 53, a recording end mark is written in the RAM in step 67, and the flow returns to the main routine (FIG. 6).

Figure 8A:
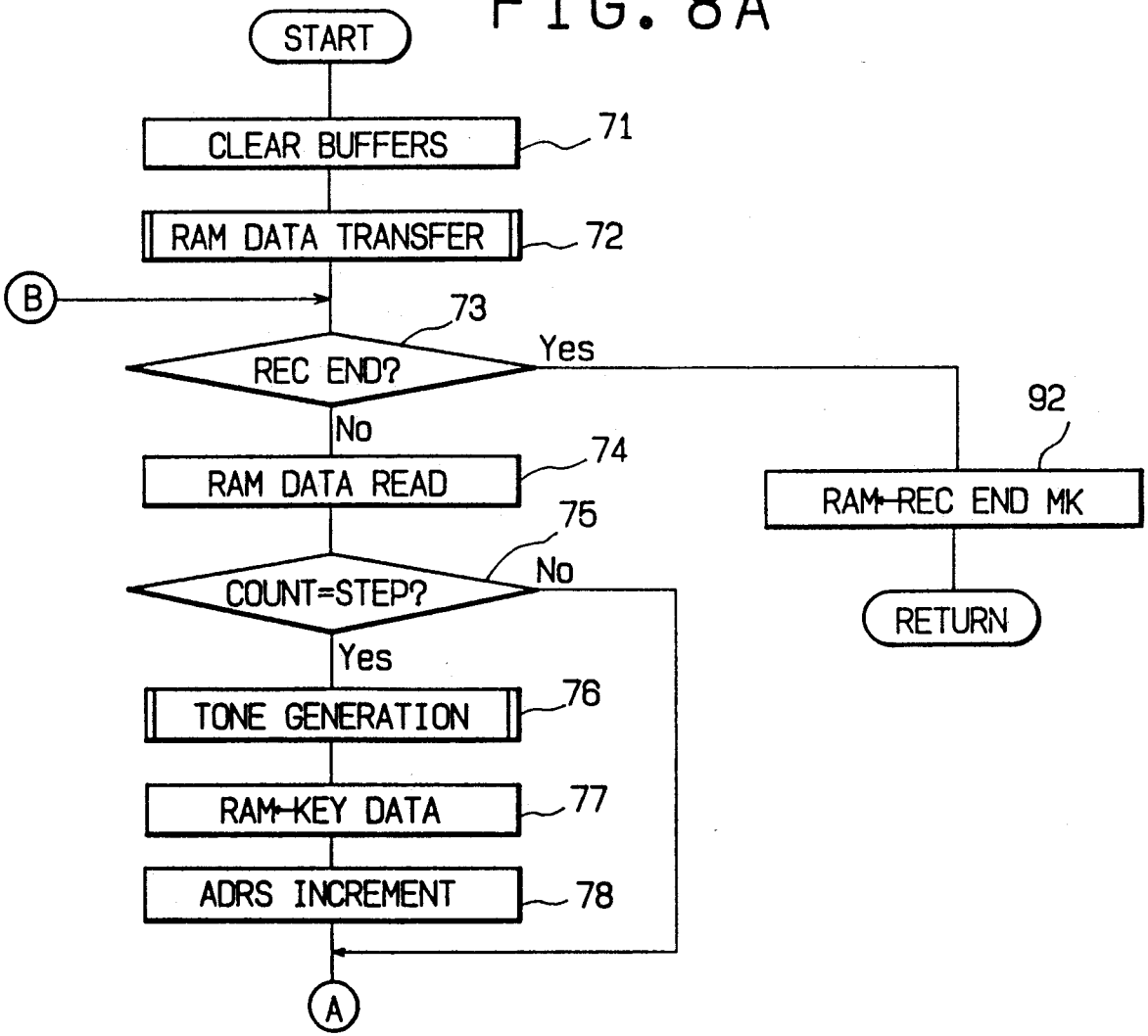
FIGS. 8A and 8B are flow charts showing overwrite-recording processing shown in FIG. 6.
Figure 8B:
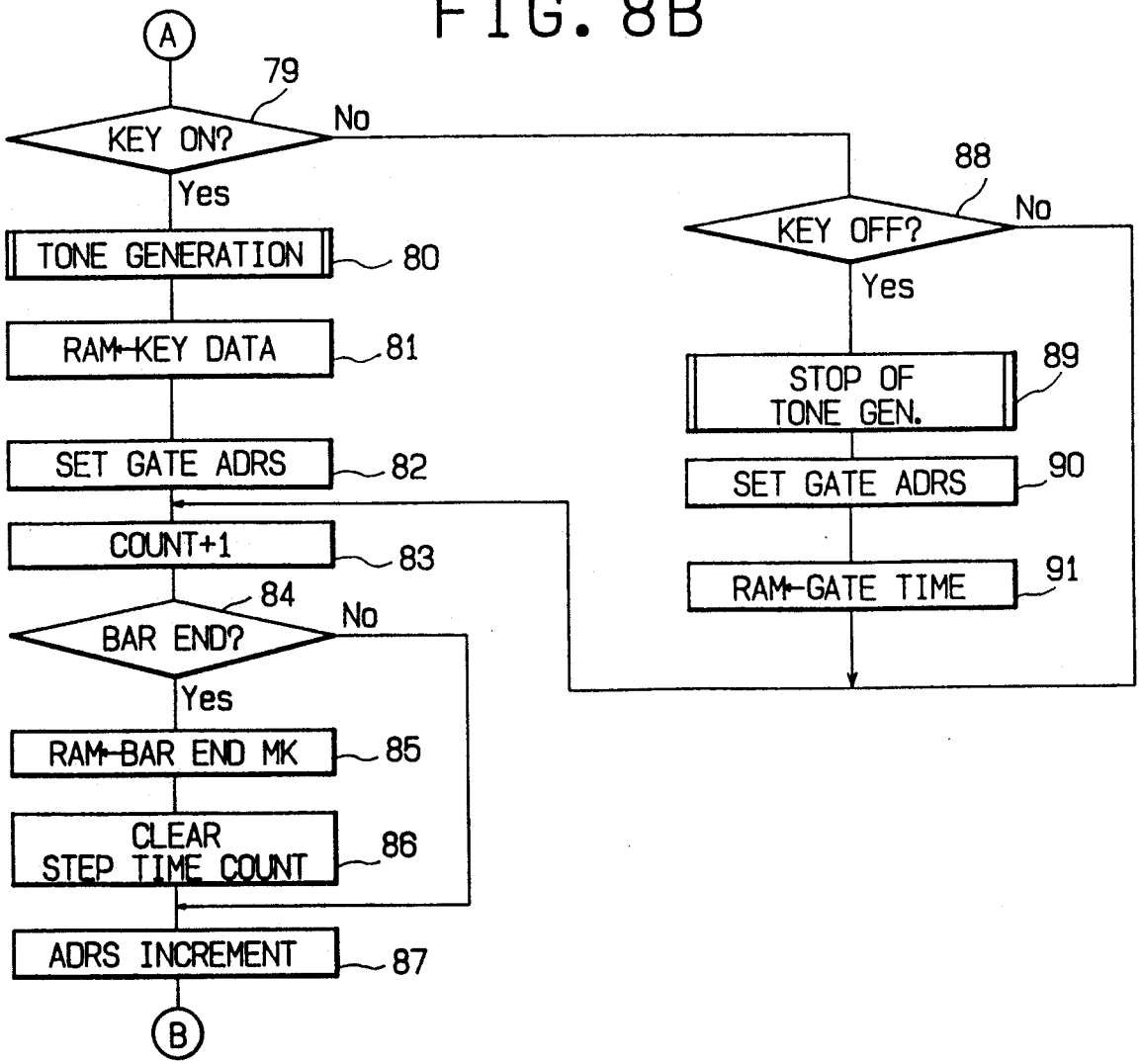

FIGS. 8A and 8B show the flow of overwrite-recording routine. In step 71, the buffer area for registers, flags, and the like is cleared, and in step 72, recorded data A are transferred from the RAM area 16*a* to the RAM area 16*b*, as shown in FIG. 5. In step 73, the end of recording is checked. If NO in step 73, one key data (4 bytes) of the recorded RAM data A is read out in step 74. In step 75, it is checked if a tempo clock count value is equal to the step time data of the readout key data. If YES in step 75, since a time for playing back the key data is reached, tone generation processing is executed in step 76. At the same time, in step 77, the key data A subjected to the tone generation processing is written in the area 16*a* of the RAM 16, as shown in FIG. 5, and in step 78, the read/write address is advanced by four bytes.

After the address is incremented in step 78, or if it is determined in step 75 that the tempo clock count value is not equal to the readout step time data, tone generation/tone generation stop processing, and key data write processing upon detection of key ON and OFF events are executed in steps 79 to 91. In these processing operations, tone generation and additional write processing operations of the performance data B are performed. However, since the detailed processing steps are the same as steps 54 to 66 in FIG. 7, a detailed description thereof will be omitted.

As a result, as shown in FIG. 5, the recorded performance data A and the additional performance data B are mixed and written in the RAM area 16*a* in the order of step times.

When key data is written in step 81, tag="1" indicating additional recording is written in the MSB of the fourth byte. In address increment processing in step 81, only the write address of the area 16*a* of the RAM 16 is incremented. Therefore, since the read address of the RAM area 16*b* is not incremented in step 87 in the overwrite mode, all the recorded performance data A in the area 16*b* can be preserved, and are written again in the area 16*a*.

If both the write address of the area 16*a* and the read address of the area 16*b* are incremented in step 87, recorded key data A is read out and written again while skipping the next key data A to be subjected to tone generation processing next. Therefore, overwrite processing for replacing the skipped key data A with additionally played key data B can be performed.

Figure 9:
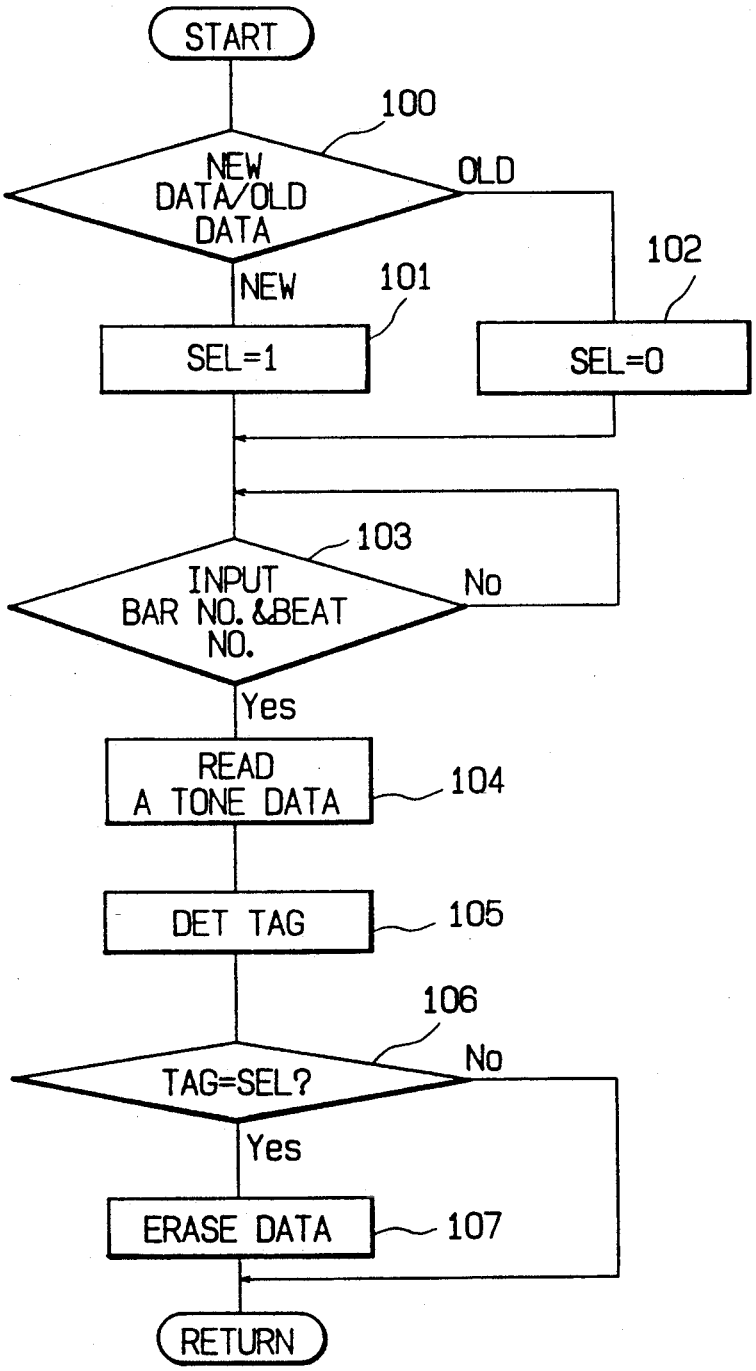
FIG. 9 is a flow chart showing erasing processing shown in FIG. 6.

FIG. 9 shows the flow of the erase processing. In step 100, it is checked if data to be erased designated by the data designation button 10*f* of the recording/playback operation unit 10 in FIG. 2 is new or old data. If the overwritten new data is designated, a flag SEL is set to be "1" in step 101; otherwise, i.e., if the old data is designated, the flag SEL is set to be "0" in step 102. The bar number and the beat number of the data to be erased input from the panel switches 13 are detected, and key data for one tone having the designated bar and beat number is read out in step 104. In step 105, the value of tag data (TAG) in the readout data is detected. In step 106, the flag SEL is compared with the value TAG, and if these values are equal to each other, the corresponding data is erased in step 107. If the erase operation is ended or if no coincidence is found between TAG and SEL in step 106, the flow returns to the main routine.

With the above-mentioned processing, one of old and new data can be selected and erased at desired bar and beat positions.

According to the present invention, since a user can re-record additional performance data to mix or replace it with recorded performance data while playing back the recorded performance data and listening to playback tones, he or she can insert or correct desired tones in relation to the overall flow of the already recorded performance. Therefore, in an electronic musical instrument of this type, a composition by utilizing a recording operation of performance data and an automatic performance can be facilitated.

What is claimed is:

1. A performance data recording apparatus comprising:

read means for reading first performance data including a note data string previously recorded in correspondence with a previous operation of a keyboard from a first storage means, and supplying the first performance data to tone generating means, the tone generating means generating a musical tone from the first performance data;

said note data string including tone pitch, tone timing, tone duration, and tone strength information;

first write means for writing the first performance data supplied to the tone generating means in a second storage means, in parallel with the generation of the musical tone by the tone generating means; and second write means, operated parallel to said read means and said first write means, for writing performance data, in said second storage means, wherein said second performance data is generated in correspondence with a real time operation of the keyboard, supplied to the tone generating means, and merged with said first performance data in a tone timing order in said second storage means;

tag writing means, connected to said second write means for adding tag data, indicating the second performance data in the merged performance data;

means for selecting one of the first and second performance data in the merged performance data;

means for detecting the tag data in the merged performance data; and erasing means for erasing the selected one of the first and second performance data in the merged performance data, according to the tag data.

2. The apparatus of claim 1, wherein the first and second performance data is also supplied to the tone generation means.

3. The apparatus of claim 1, wherein said first and second write means increment an address of said second storage means each time a note of the merged performance data is written to said second storage means.

4. The apparatus of claim 1, wherein said means includes a time base counter and when a time count of said time base counter equals a tone timing value of the first performance data, said read means supplies the first performance data to the tone generating means and increments a read address of said first storage means.

5. The apparatus of claim 4, wherein said second write means increments a read address of said read means every time one note of the second performance data is written.

6. The apparatus of claim 1, further comprising:

tag write means, connected to said second write means, for adding tag data indicating the second performance data in the merged first and second performance data.

7. The apparatus of claim 6, further comprising:

means for selecting one of the first and second performance data in the merged first and second performance data stored in said second storage means;

means for detecting the tag data; and erasing means for erasing the selected one of the first and second performance data in the merged first and second performance data in accordance with the tag data.

8. A performance data recording apparatus, comprising:

storage means, including a first memory portion, for storing first performance data;

reading means for reading the first performance data;

keyboard means for generating second performance data;

timing means for supplying performance time data to the first and second performance data;

tone editing means for reproducing the first performance data and editing portions of the first performance data with the second performance, in accordance with the performance time data as desired by a user;

wherein the edited first performance data is recorded in a second portion of said storage means, in parallel with the reproduction of the first performance data, such that the first performance data and the edited first performance data both are stored in said storage means, upon completion of editing by said tone editing means;

tag write means, connected to said tone editing means, for adding tag data indicating the edited portions of the edited first performance data;

means for selecting one of the edited portions and the non-edited portions of the edited first performance data;

means for detecting the tag data in the edited first performance data; and erasing means for erasing and selecting one of the edited and non-edited portions of the edited first performance data, in accordance with the tag data.

9. The performance data recording apparatus of claim 8, further comprising:

tone generating means for generating a musical piece represented by the first performance data or the edited first performance data, depending on a selection mode by the user.

10. A performance data recording apparatus comprising:

read means for reading first performance data, including a note data string previously recorded in correspondence with a previous operation of a keyboard, from a first storage means and for supplying the first performance data to tone generating means;

said note data including tone pitch, tone timing, tone duration and tone strength information;

first write means for writing the first performance data in a second storage means in parallel with tone generation of the first performance data; and second write means, operated parallel to said read means and said first write means, for writing second performance data in said second storage means, wherein said second performance data is generated in correspondence with a real time operation of the keyboard, supplied to the tone generation means, and merged with the first performance data in correct tone timing order in said second storage means;

wherein said first and second write means increment an address of said second storage means every time one note of the merged performance data is written in said second storage means;

wherein said read means supplies the first performance data to the tone generation means and increments a read address of said first storage means when a time count of a time base counter in said read means equals a tone timing of the first performance data;

wherein said second write means increments a read address of said read means every time one note of the second performance data is written in said second storage means, so that reading of the corresponding first performance data in said first storage means is skipped, wherein said skipped first performance data is replaced with the second performance data recorded in said second storage means.

* * * * *